US006516740B2

(12) United States Patent
Berg, Sr. et al.

(10) Patent No.: US 6,516,740 B2
(45) Date of Patent: Feb. 11, 2003

(54) LIFT-OFF COVER ASSEMBLY FOR A BARGE

(75) Inventors: Robin Berg, Sr., Hudson, WI (US); Roderick Annis, Southaven, MS (US)

(73) Assignee: Proform Corporation, Minneapolis, MN (US)

( * ) Notice: Subject to any disclaimer, the term of this patent is extended or adjusted under 35 U.S.C. 154(b) by 0 days.

(21) Appl. No.: 09/880,896

(22) Filed: Jun. 15, 2001

(65) Prior Publication Data

US 2002/0189519 A1 Dec. 19, 2002

(51) Int. Cl.[7] ..... B63B 19/12
(52) U.S. Cl. ..... 114/201 R
(58) Field of Search ..... 114/201 R, 26, 114/202, 203

(56) References Cited

U.S. PATENT DOCUMENTS 3,730,128 A * 5/1973 Burwell ..... 114/201
6,016,761 A 1/2000 Berg, Sr.
6,138,597 A 10/2000 Berg, Sr.

* cited by examiner

*Primary Examiner*—Ed Swinehart

(57) ABSTRACT

A barge cover assembly includes at least one first cover section and at least one end cover section. The first cover section includes a stairway that is within a rib profile. The first cover section also includes a door that protrudes only slightly above an upper surface such that the door is not impacted when cover sections are stacked. The door opening is approximately four feet by eight feet such that a standard-sized sheet of a material such as plywood can be used to cover the door opening in the event that a door has been removed from the cover section. The end cover section has an end with a stepped rib/valley structure wherein successive ribs and valleys form steps of the stairway.

19 Claims, 10 Drawing Sheets

DOOR CLOSED

CENTER RIB OF COVER

END COAMING TAPER DETAIL

LIFT-OFF COVER ASSEMBLY FOR A BARGE

BACKGROUND OF THE INVENTION

1. Field of the Invention

The present invention relates to a lift-off cover assembly for ships, barges or the like which includes a plurality of adjacently positioned curved sections and end sections. The cover assembly can be made of a semirigid to rigid light-weight material such as fiberglass reinforced resin and is adapted to be placed on the barge so as to define a protected storage space thereunder.

2. Discussion of the Background

A barge cover assembly has been described in my earlier application entitled "A Lift-Off Cover Assembly For a Barge," U.S. application Ser. No. 09/373,577, U.S. Pat. No. 6,138,597 (the "previous cover assembly"), the contents of which are hereby incorporated by reference herein. The previous cover assembly is superior to known barge cover assemblies in many respects. I have since conceived of several improvements to the previous cover assembly.

One issue noted with the previous cover assembly is that mishandling may lead to cracks being developed at or near the locations where side stairways protrude from the profile of the ribs. It would be desirable to eliminate these potential cracks even when cover sections are mishandled.

The previous cover assembly provides advantageous doors which receive a significant amount of wear and tear, some of which occurs during stacking and unstacking of the cover sections. The reduction of wear and tear on the doors, especially that which occurs during stacking and unstacking of cover sections, is desirable.

Another feature of the prior generation assembly is the provision of raised edges on the sides of stairs on end cover sections. These were provided to clearly define step areas, and/or raised steps. The incorporation of this feature absorbs additional man hours and material in the manufacturing process as the placement of 'wetted out' woven roving sections, also referred to as passes, in these areas may require cutting of the woven rovings to make them fit properly. What is needed is an end cover stair section that can be clearly identified and fabricated without requiring manufacturing personnel to cut wetted out roving sections in the manufacturing process.

SUMMARY OF THE INVENTION

Accordingly, an object of this invention is to provide for a lift-off cover assembly for barges which addresses the above-mentioned issues and includes the following features.

In one aspect of the present invention, side stairs (stairways that are oriented in the port/starboard direction rather than the bow/stern direction) are provided such that steps and risers are completely within the rib profiles. That is, the stairs are formed such that no portion of a riser or step protrudes above the top/peak of a rib or below the bottom/valley of a rib. Because the stairways are provided within the rib profiles, the stairways are protected during stacking and unstacking handling operations.

Another aspect of the present invention is the provision of low profile doors (which protect and keep dry grain and/or other products on the barge) that extend only slightly beyond the tops/peaks of ribs such that the doors are not impacted when cover sections are stacked. This reduces the wear and tear on the doors. Additionally, the size of the doors are altered with respect to the previous cover assemblies. The door opening is sized and shaped to accept a standard 4 ft.×8 ft. sheet of material. This feature allows a repair to be easily affected in the event that a door is missing by simply obtaining a 4×8 sheet of a material such as plywood and taping the plywood into the opening. This ease of repair is important in locations such as docks where access to tools to cut material such as plywood to fit non-standard size openings is not always available.

The present invention also provides end cover sections with center stairways (stairways that are oriented in the bow/stern direction and that are aligned with a center pathway) that can be fabricated without the necessity of cutting woven roving sections. Impregnator machines are often used during the manufacturing process. Machines such as these can produce continuous sheets of multiple layers (e.g. three 24 oz woven roving layers) at once. The continuous sheet have a width of, for example, twenty seven inches. These sheets of material are layed up across the width of the molds one sheet at a time side by side (typically with a three inch overlap) to form cover sections. The raised edges and raised steps provided with the center stairways of the previous cover sections presented manufacturing process issues addressed in part by requiring these layers to be cut at the location of the raised edge. By providing center stairways with a noticeable but smooth curve at the edges of the width of the steps, rather using a raised section to define the width of the stairway, and by using the peaks and valleys of successive ribs for the steps, the stairways can be manufactured without requiring cutting of the layer sections while still providing for an easily recognizable and well defined stairway.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
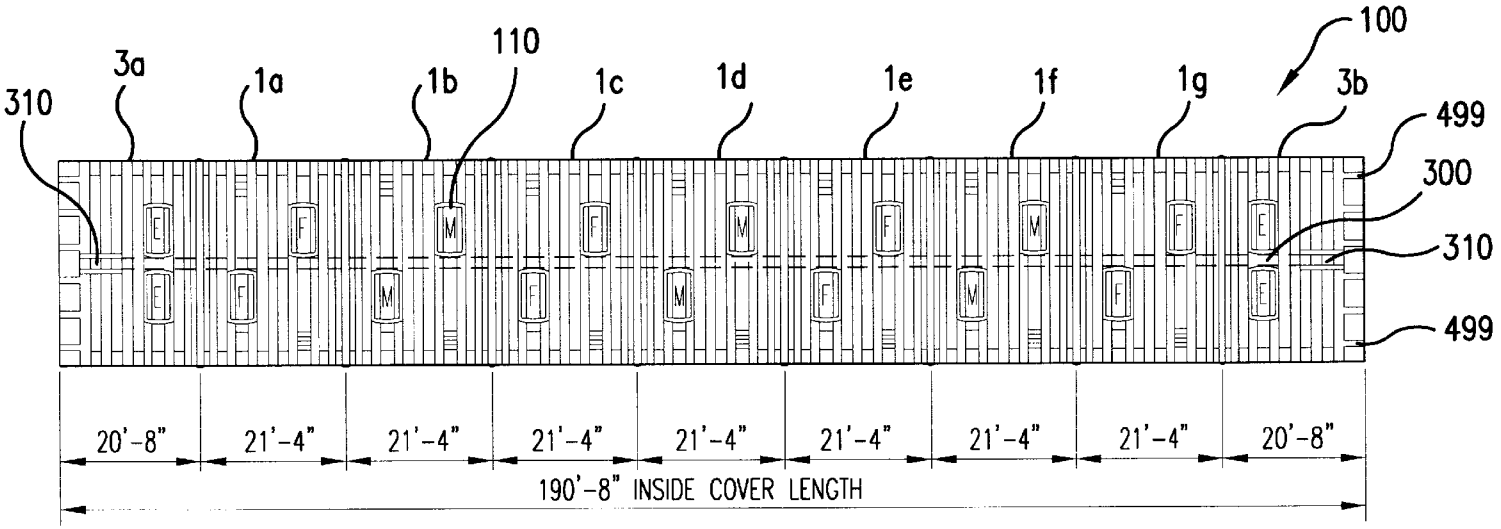
FIG. 1 is a top view of a barge cover assembly according to a preferred embodiment of the present invention.
Figure 2:
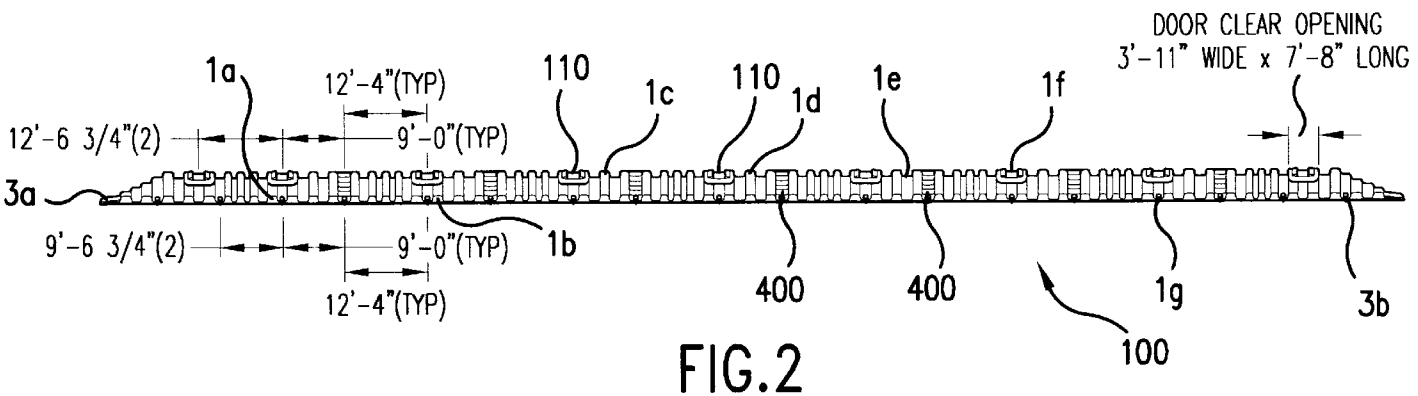
FIG. 2 is a side view of the barge cover assembly of FIG. 1.
Figure 3:
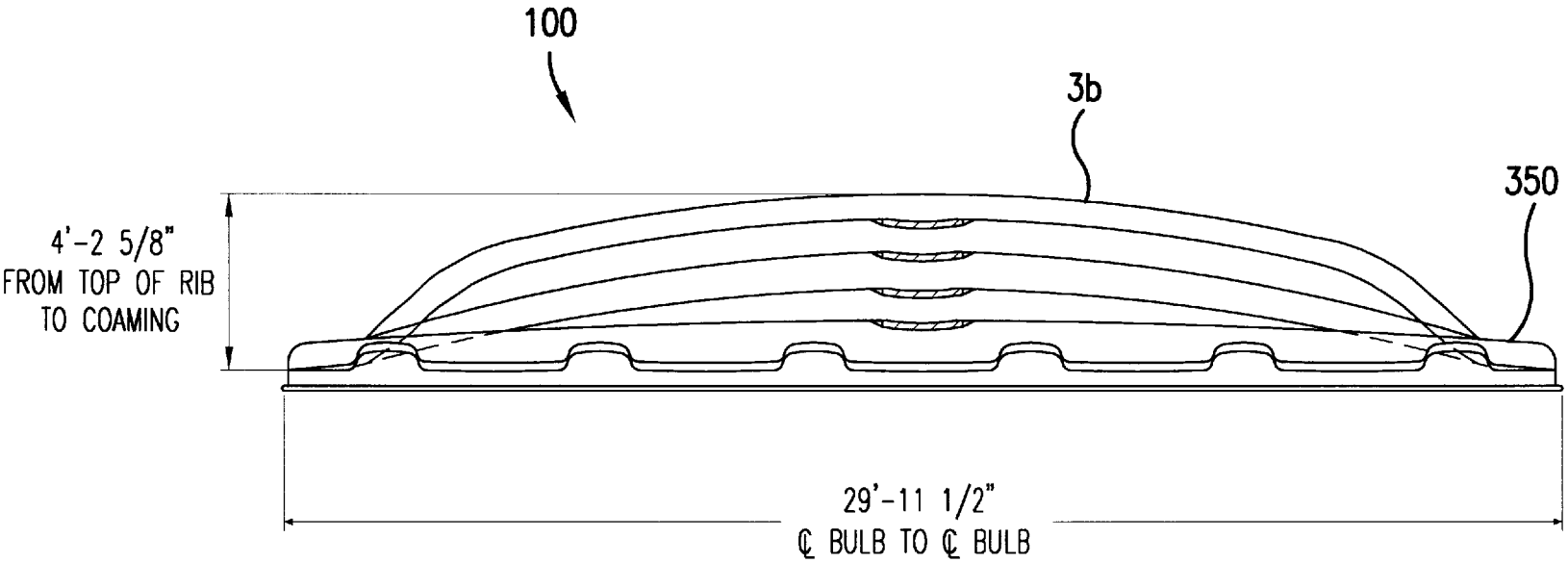
FIG. 3 is an end view showing the end cover section of the barge cover assembly of FIG. 1.

Referring now to the drawings, wherein like reference numerals designate identical or corresponding parts throughout the several views, FIGS. 1–3 illustrate top, side and end views, respectively, of a lift-off barge cover assembly 100 according to the present invention. The barge cover assembly 100 can include a plurality of curved cover sections 1*a*–1*g* as illustrated in FIG. 1. Although the embodiment of FIG. 1 shows seven curved cover sections 1*a*–1*g*, it is recognized that the number of curved cover sections depends on the size of the barge to be covered. The number of cover sections 1*a*–1*g* and their dimensions shown as in FIG. 1 are appropriate for a standard 200 foot box barge layout. Each of the curved cover sections 1*a*–1*g* can be fitted to each other to provide for the barge cover assembly 100. On opposite ends of the curved cover sections 1*a*–1*g*, the barge cover assembly 100 includes curved end cover sections 3*a*, 3*b*. The curved end cover sections 3*a*, 3*b* can be fitted to the ends of the curved cover sections 1*a*–1*g* at their boundaries. The curved cover sections 1*a*–1*g* and end cover sections 3*a*, 3*b* can be made of a semirigid to rigid material such as, for example, fiberglass reinforced resin (structural fiberglass reinforced plastic).

Each of the cover sections 1*a–g* and end cover sections 3*a–b* includes two doors 110, with one door 110 disposed on each side of a central walkway 300. The doors 110 allow cargo such as grain to be loaded onto the barge without the necessity of moving any of the cover sections 1*a–g*. The center walkway 300 is bounded on either end by a center stairway 310 on the end cover sections 3*a–b*. Each of the cover sections 1*a*–1*g* also includes a side stairway 400.

Figure 4:
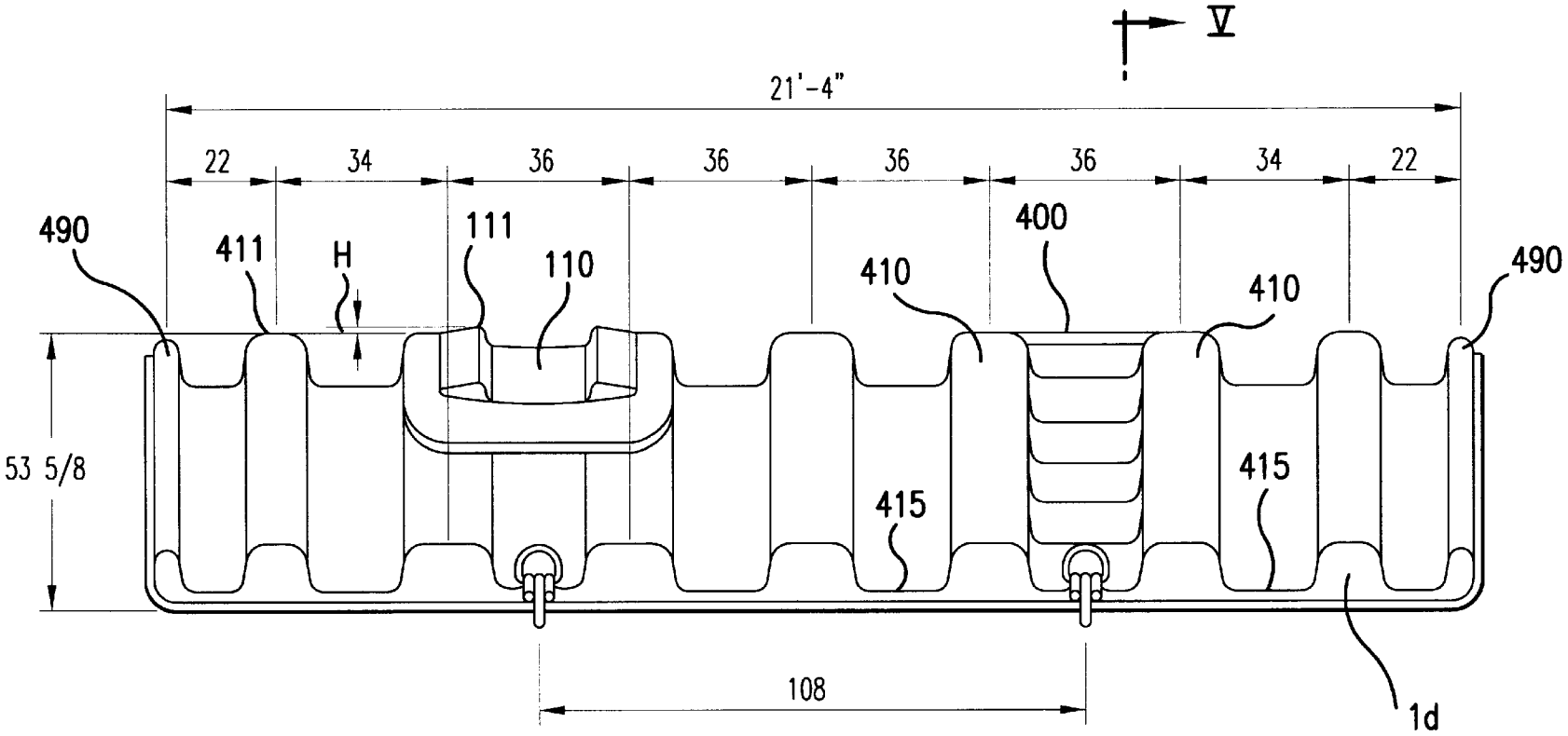
FIG. 4 is a side view of a cover section of the cover assembly of FIG. 1.
Figure 5:
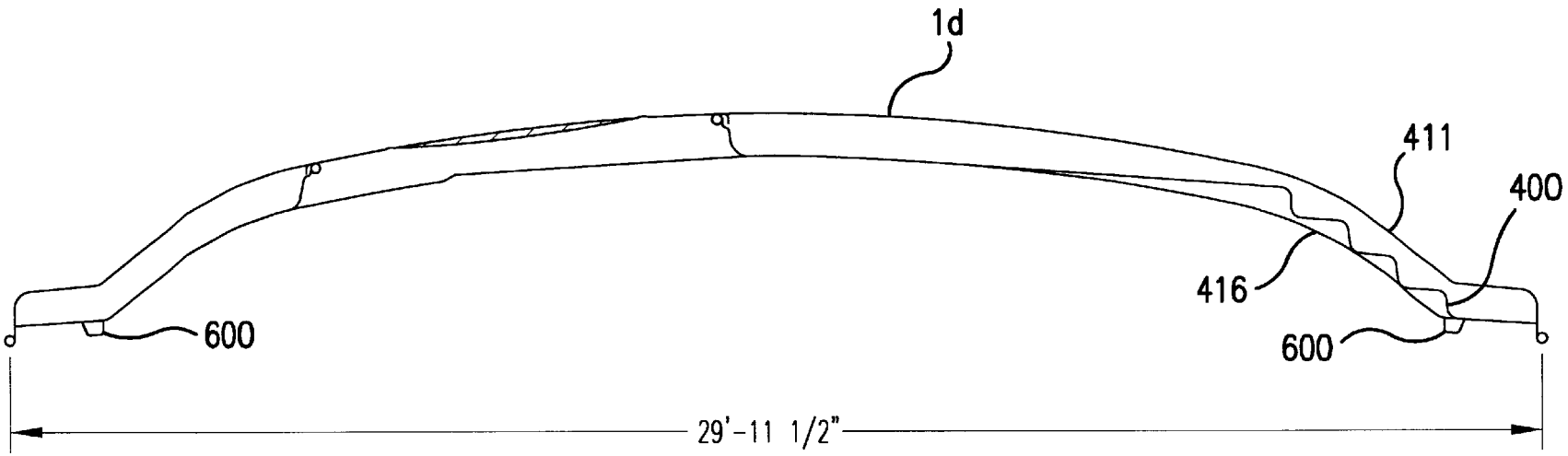
FIG. 5 is a cross-sectional view of the cover section of FIG. 4 taken along the line V—V.

A side view of cover section 1*d* (cover sections 1*a–g* are identical except for the configuration of weather seals 490 at their ends) is shown in FIG. 4. The side stairway 400 is placed between two ribs 410. As shown more clearly in FIG. 5, which is a cross sectional view of cover section 1*d* taken along the line V—V of FIG. 4, no portion of the stairway 400 extends above the top 411 of rib 410 or the bottom 416 of valley 415 (as used herein, a valley refers to the lower portion of a cover section between a pair of ribs 410). Said another way, the stairway 400 is contained completely within the rib profile. The lack of any protruding surfaces on the stairway 400 helps to prevent damage that may occur on known cover sections during careless or improper stacking and unstacking operations where portions of stairways that protrude from the rib profile in known cover sections can suffer impact damage.

Another area where known cover sections can be damaged due to impact through careless handling is in the door area. Doors (and sometimes door openings) in known cover sections typically extend above the top surface (the rib tops in ribbed cover sections or the upper surface of non-ribbed sections) of the cover section such that the doors can be impacted when cover sections are stacked. Ideally, the known cover sections are stacked such that the doors of stacked cover sections are aligned, thereby avoiding damage. In fact, the doors are often used as alignment aids by dock personnel. Unfortunately, due to human error, the covers sections are sometimes misaligned during the stacking operation. This misalignment can result in impact damage to the doors, door openings, and surrounding areas.

Figure 6:
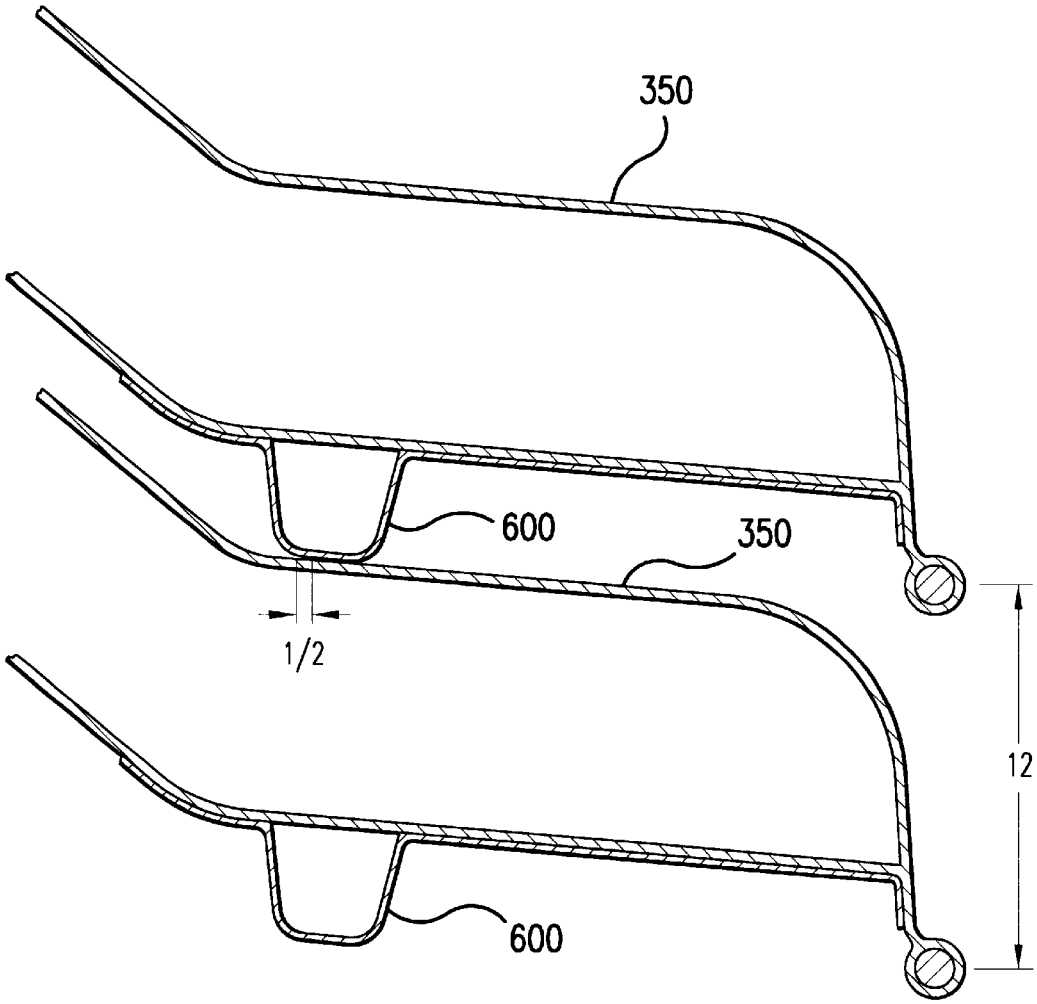
FIG. 6 is a cross-sectional view of portions of two stacked cover sections.

The present invention minimizes this damage by providing low profile doors that extend only minimally, if at all, above the tops of ribs. Referring now back to FIG. 3, it can be seen that the sides of cover sections include flattened portions 350 at their ends. As seen in FIG. 6, stacking brackets 600 (which typically run along substantially the entire length of the cover section) are provided along the underside of the flattened portions 350. These stacking brackets are typically approximately three and a half inches in height, which provides approximately three and a half inches of clearance between stacked cover sections. Referring now to FIG. 4, it can be seen that the uppermost point 111 of door 110 extends above the top 411 of rib 410 by a height H. Preferably, the height H is less than approximately one inch. Because the clearance between covers provided by the stacking bracket is approximately three and a half inches, and the height H is less than approximately one inch, no portion of the door 110 will impact or be impacted by another cover section during stacking. This will reduce damage to the cover sections.

Figure 7:
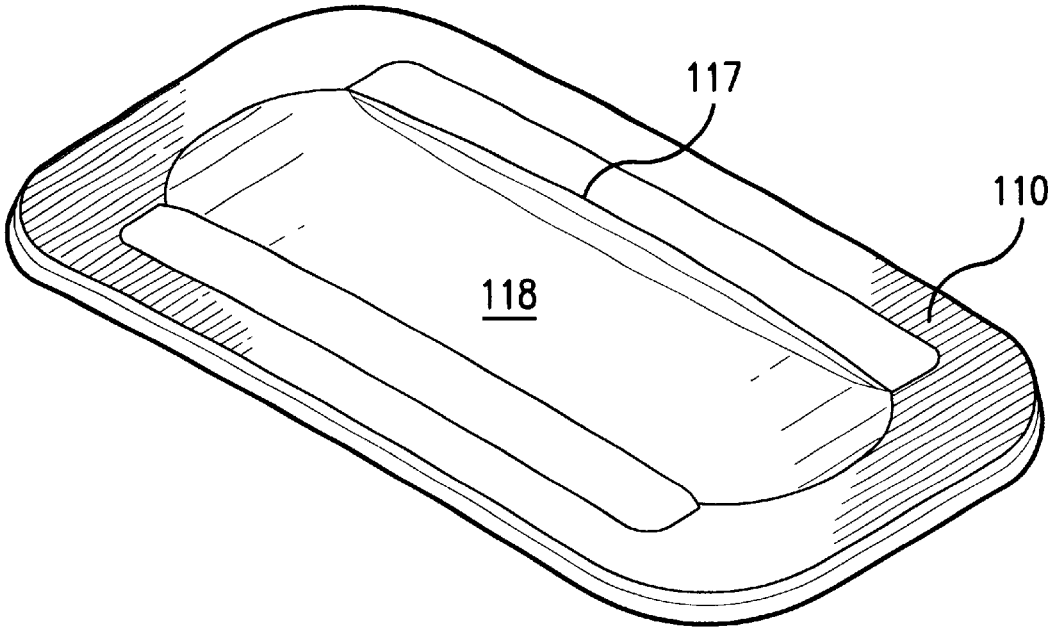
FIG. 7 is a perspective view of a cover section door according to a preferred embodiment of the present invention.
Figure 8A:
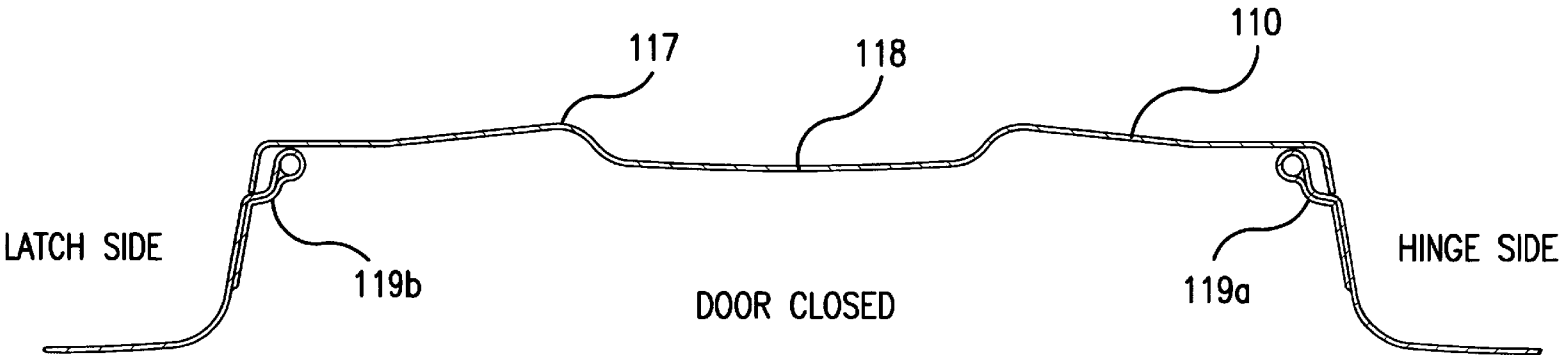
FIGS. 8*a* and 8*b* are cross sectional views showing the door of FIG. 7 in the closed and open positions, respectively.
Figure 8B:
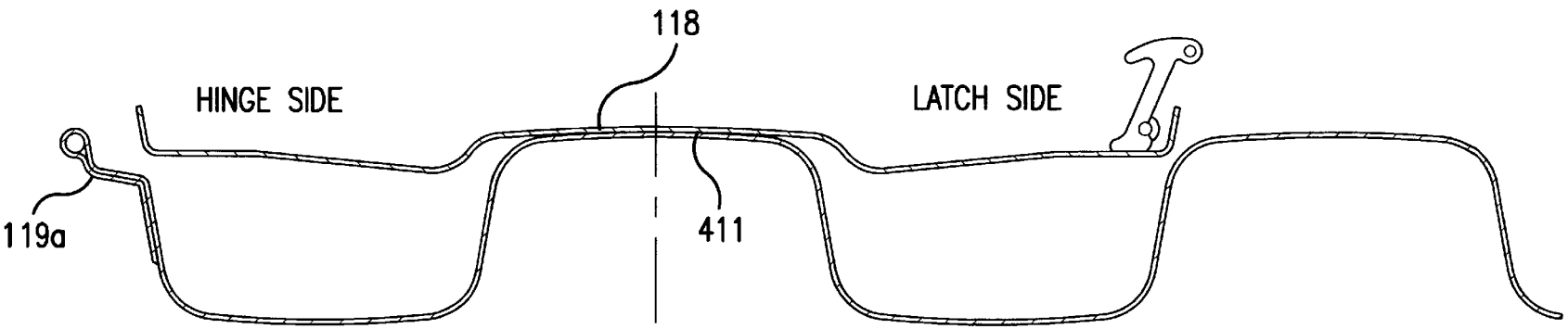

A perspective view of the door 110 is shown in FIG. 7. The door 110 includes a central portion 118 that is curved to conform to the top of a rib surface 411 when open as shown in FIG. 8*b*. This allows an even distribution of weight when the door is open and resting on a rib top. When in the closed position, the central portion 118 is depressed relative to the uppermost portion 117 of the cover 110 as shown in FIG. 8*a*. The door 110 completely drains of rain and water when in the closed position.

The opening for the door 110 is approximately 3 feet 11 inches by 7 feet 9 inches. This opening size allows a standard 4 foot by 8 foot sheet of material, such as plywood, to be placed over the opening in the event that a door 110 has been removed from a cover section 1*a–g*. The plywood may be secured to the cover section 110 by taping the plywood to the sides 119*a*, 119*b* (FIG. 8) of the opening. The ability to use a standard size sheet of material such as plywood to protect the cargo or the barge until the door can be replaced may be especially important in a dock environment, where saws (or power to run saws) to cut sheet material may not be readily available.

Figure 9:
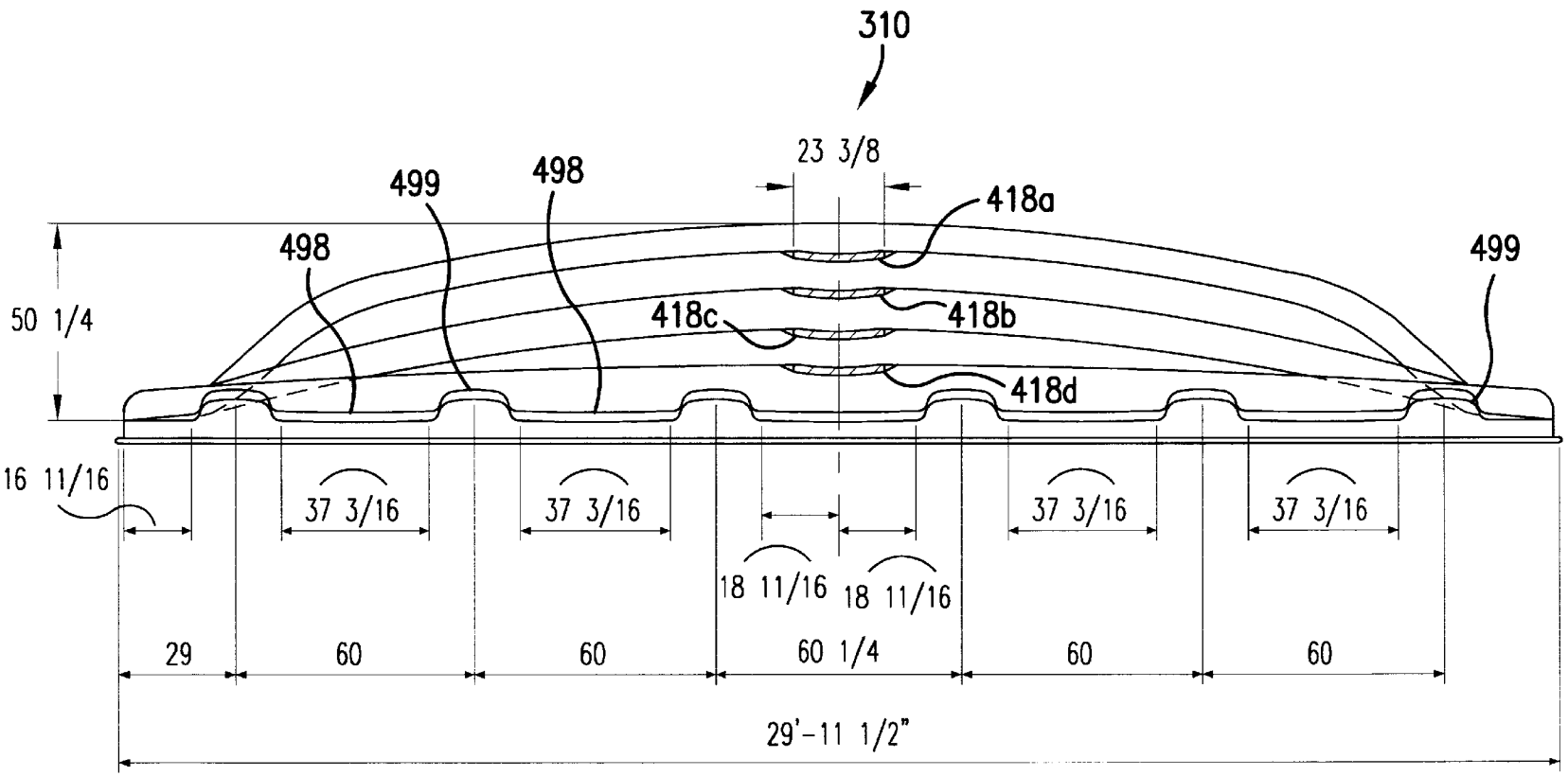
FIG. 9 is an end view of an end cover section of the cover assembly of FIG. 1.

Referring now back to FIG. 1, it can be seen that center walkway 300 terminates at either end with an end stairway 310 on end cover sections 3*a,b*. An end view of end cover section 3*b* is shown in FIG. 9 and a side view is shown in FIG. 10. As seen most clearly in FIG. 10, the distal portion 1000 of end cover section 3*b* has a stepped structure formed by a succession of ribs 410*a–c* and valleys 415*a–c* of varying heights. That is, valley 415*a* is lower than the top of rib 410*a* but higher than the top of rib 410*b*. Rib 410*b* is higher than valley 415*b*, which in turn is higher than rib 410*c*. Rib 410*c* is in turn higher than valley 415*c*. Thus, the alternating series of ribs and valleys forms a stepped structure.

In order to clearly define a stairway, the center portions 418*a–d* of valleys 415*a,b* and ribs 410*b,c* are depressed slightly as shown in FIG. 9. This clearly defines the stairway 310. In preferred embodiments, a non-skid surface is applied in the areas of the depression. By making the steps depressed, rather than flat, the cover section 3*b* is strengthened locally.

Figure 10A:
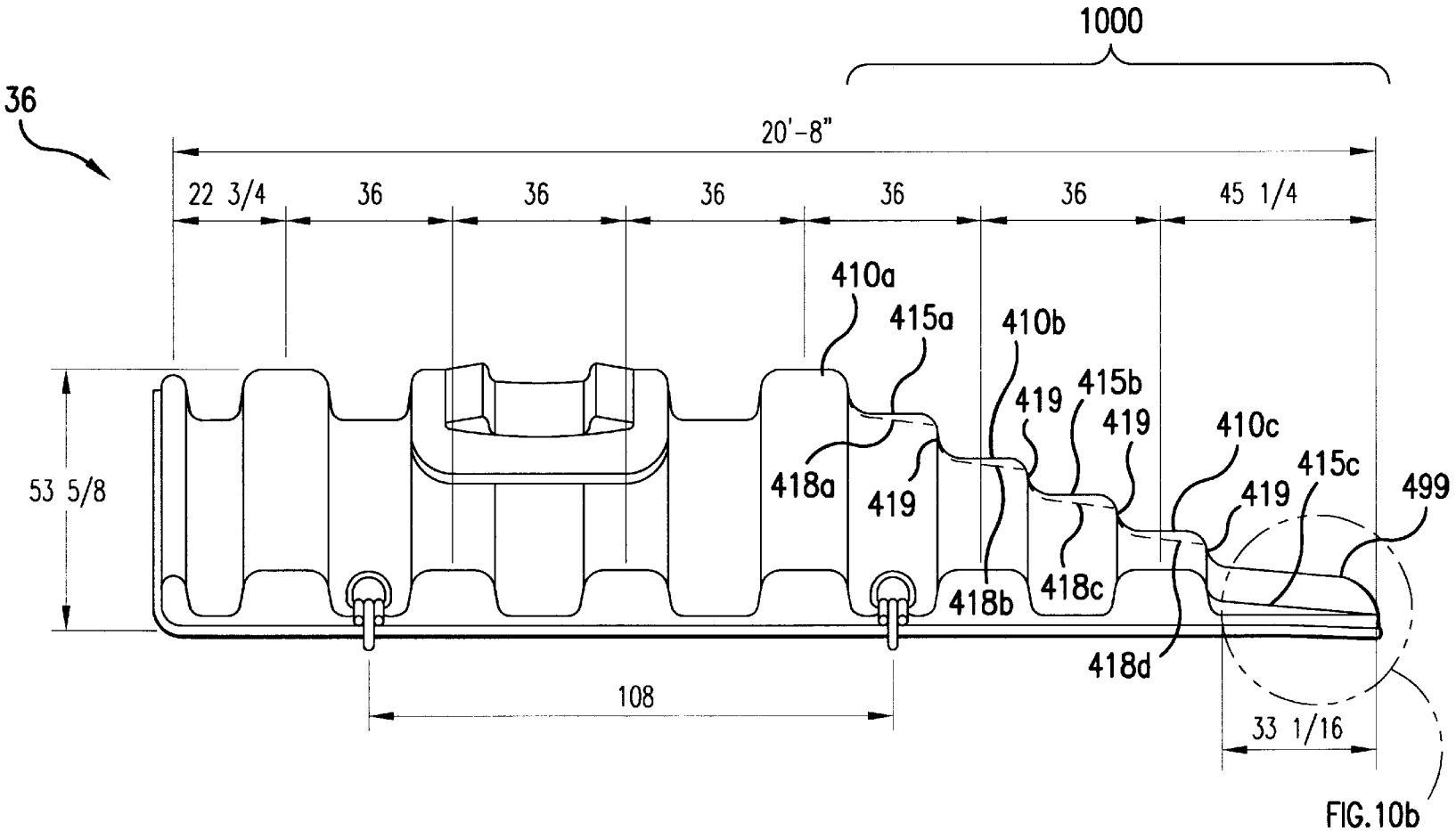
FIGS. 10*a,b* are side views of the end cover section of FIG. 9.

As shown in FIG. 10*a*, the steps 418 and risers 419 of the stairway 310 are pitched. That is, the steps 418 are pitched slightly with respect to the horizontal axis and the risers 419 are pitched slightly with respect to the vertical axis. This pitch helps to prevent water from accumulating on the stairway 310. Additionally, corners of the stairway 310 where the steps 418 and risers 419 meet are rounded. The rounding of the corners and the formation of a depressed area to define the stairway 310 allows the end cover section 310 to be formed without requiring the cutting of continuous sheets of fiberglass roving, which is used to form the cover sections in preferred embodiments of the invention. This should be contrasted with known cover sections that use raised portions to define stairways. As discussed above, such raised portions may require cutting and patching of continuous sheets of fiberglass woven roving during the manufacturing process. This adds significantly to manufacturing cost.

Figure 10B:
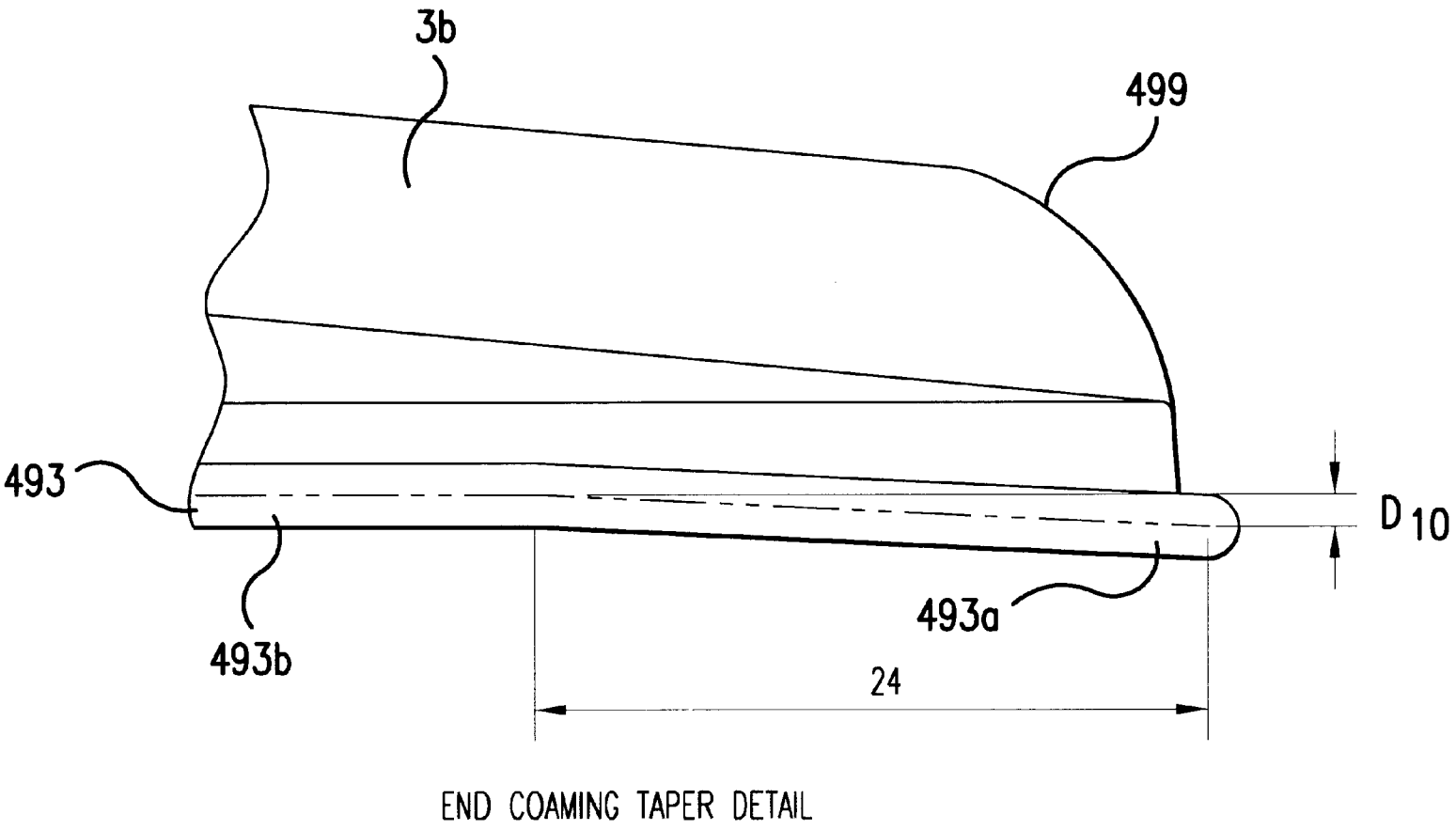

Referring now to FIG. 10*b*, it can be seen that the cover section 3*b* includes a lip 493 that includes an end 493*a* that extends a distance $D_{10}$ further downward (relative to the remainder 493*b* of the lip 493) over the coaming (not shown in FIG. 10). The provision of the extended end 493*a* accounts for any mismatch (for example, the coaming on the barge may not be perfectly straight) between the barge and cover. This may also provide additional protection for the barge cargo.

The tops of ribs 410 on cover sections 1*a–g* and 3*a–b* are arched along their width and curved along their length. Said a different way, the rib tops have compound curves. The use of compound curves provides greater strength as compared to single-curved ribs (i.e. arched ribs with flat tops). These compound-curved ribs are known in the art, having been used, for example, in cover sections manufactured by Proform Corp. more than 20 years ago. The present invention provides for compound-curved ribs and compound-curved valleys. In preferred embodiments, one or more of the curves are catenary. Preferably, the curves are present throughout the cover, including the center walkway between doors. Furthermore, in other areas, such as in stairways, compound curves are also used. For example, the steps 418 of FIG. 10*a*, in addition to being pitched, are also slightly curved. As another example, stiffeners 499 (the rib-like structures oriented in a direction perpendicular to ribs 410 along the outermost portion of the distal end 1000 of end cover sections 3*a,b*), in addition to being new themselves, and the valleys 498 between the stiffeners 499, also include compound curves in a fashion similar to the compound curves of the ribs 410 and valleys 415. The extensive use of compound curves results in a significantly stronger cover assembly 100.

Obviously, numerous modifications and variations of the present invention are possible in light of the above teachings. It is therefore to be understood that within the scope of the appended claims, the invention may be practiced otherwise than as specifically described herein.

What is claimed is:

1. A cover assembly for a barge comprising:

a first cover section;

the first cover section having at least two ribs, each of the ribs having a rib profile, the first cover section further having a stairway formed between the two ribs such that the stairway is contained within the rib profile of the two ribs; and a second cover section sized and shaped to be fitted to the first cover section.

2. The cover assembly of claim 1, wherein said stairway comprises a plurality of non-skid surfaces.

3. The cover assembly of claim 1, wherein the first cover section and the second cover section comprise fiberglass reinforced resin.

4. The cover assembly of claim 1, wherein the second cover section includes a second stairway formed between a second pair of ribs such that the second stairway is contained within a profile of the second pair of ribs.

5. A cover assembly for a barge comprising:

a first cover section having an arched cross-sectional shape, a rib formed therein, and an upper surface;

the first cover section having an opening formed therein, the first cover section further including a door movably attached to the first cover section, the door being movable to a first position in which the opening is substantially covered and movable to a second position in which the opening is substantially uncovered, the door being sized and shaped to substantially cover the opening and protrude less than approximately one inch over the upper surface in the first position; and a second cover section sized and shaped to be fitted together with the first cover section, wherein the door has a depression formed therein, the depression being positioned and sized to receive the rib when the door is in the second position such that a portion of the door is below a top surface of the rib.

6. The cover assembly of claim 5, wherein the door further comprises a rib formed therein.

7. The cover assembly of claim 5, wherein the opening is generally rectangular in shape and has a first width of approximately three feet and eleven inches and has a second width of approximately seven feet and nine inches.

8. A cover assembly for a barge comprising:

a first cover section; and a first end cover section, the first end cover section having a center axis that is parallel to a longitudinal axis of a barge when the first end cover section is installed on a barge, the first end cover section having an arched cross-sectional shape and a proximal end and a distal end, the proximal end being sized and shaped to be fitted together with the first cover section, the distal end comprising a plurality of alternating ribs and valleys, the ribs and valleys having heights such that each rib is lower than a preceding valley and higher than a subsequent valley and each valley is higher than a subsequent rib and lower than a preceding rib, each of the alternating ribs and valleys having a depression formed therein to define a step.

9. The cover assembly of claim 8, wherein an outermost portion of the distal end includes a plurality of stiffeners.

10. The cover assembly of claim 8, wherein the steps are centered on the central axis.

11. The cover assembly of claim 8, wherein the steps are pitched.

12. The cover assembly of claim 11, wherein the steps are curved.

13. A cover assembly for a barge comprising:

a first cover section having at least two first cover section ribs, each of the first cover section ribs having a rib profile, the first cover section further having a stairway formed between the two first cover sections ribs such that the stairway is contained within the rib profile of the two first cover section ribs, the first cover section having an upper surface, the first cover section having an opening formed therein, the opening being sized and shaped such that it may be substantially covered by a four foot by eight foot sheet of material, the first cover section further including a door movably attached to the first cover section, the door being movable to a first position in which the opening is substantially covered and movable to a second position in which the opening is substantially uncovered, the door being sized and shaped to substantially cover the opening and protrude less than approximately one inch over the upper surface in the closed position; and an end cover section, the end cover section having a center axis that is parallel to a longitudinal axis of a barge when the first end cover section is installed on a barge, the end cover section having an arched cross-sectional shape and a proximal end and a distal end, the proximal end being sized and shaped to be fitted together with the first cover section, the distal end comprising a plurality of alternating end cover section ribs and valleys, the end cover section ribs and valleys having heights such that each end cover section rib is lower than a preceding valley and higher than a subsequent valley and each valley is higher than a subsequent rib and lower than a preceding rib, each of the alternating end cover section ribs and valleys having a depression formed therein to define a step;

each of the first cover section ribs and end cover section ribs being compound-curved.

14. The cover assembly of claim 13, wherein the valleys are compound-curved.

15. The cover assembly of claim 14, wherein at least one curve is catenary.

16. The cover assembly of claim 15, wherein the distal end further comprises a plurality of stiffeners.

17. The cover assembly of claim 15, further comprising a lip extending around edges of the end cover section at both the proximal end and the distal end, the lip at the distal end extending further than the lip at the proximal end.

18. A cover assembly for a barge comprising:

a first cover section having an arched cross sectional shape, the second cover section being sized and shaped to be fitted over an opening of a barge, the first cover section having an opening formed therein; and a second cover section having an arched cross sectional shape, the second cover section being sized and shaped to be fitted over the opening of the barge;

wherein the first cover section has an opening formed therein, the first cover section further comprising a door connected to the first cover section by a hinge such that the door is movable between a first position in which the door substantially covers the opening and a second position, the door being sized and shaped such that the second cover section will not impact the door when the door is in the first position and the second cover section is stacked on the first cover section even if the first and second cover sections are not aligned.

19. The cover assembly of claim 18, wherein the first cover section includes a rib, and the door has a depression formed along a central axis of the door such that the depression follows a contour of a top of the rib when the door is in an open position resting on the rib.

* * * * *